US011168714B2

(12) United States Patent
Ropponen

(10) Patent No.: US 11,168,714 B2
(45) Date of Patent: Nov. 9, 2021

(54) OSCILLATION CYLINDER ARRANGEMENT

(71) Applicant: PIMATIC OY, Huittinen (FI)

(72) Inventor: Vesa Ropponen, Ivalo (FI)

( * ) Notice: Subject to any disclaimer, the term of this patent is extended or adjusted under 35 U.S.C. 154(b) by 0 days.

(21) Appl. No.: 16/757,399

(22) PCT Filed: Oct. 19, 2018

(86) PCT No.: PCT/FI2018/050768

§ 371 (c)(1),
(2) Date: Apr. 20, 2020

(87) PCT Pub. No.: WO2019/077207

PCT Pub. Date: Apr. 25, 2019

(65) Prior Publication Data

US 2020/0248725 A1 Aug. 6, 2020

(30) Foreign Application Priority Data

Oct. 20, 2017 (FI) ..... 20175931

(51) Int. Cl.
*F15B 15/04* (2006.01)

(52) U.S. Cl.
CPC ..... *F15B 15/04* (2013.01)

(58) Field of Classification Search
CPC ..... F15B 15/04; F15B 2211/325; F15B 2211/329; F16J 1/08; F16K 47/08; F16K 47/06
USPC ..... 91/307
See application file for complete search history.

(56) References Cited

U.S. PATENT DOCUMENTS

| | | | | |
|---|---|---|---|---|
| 3,720,137 | A | 3/1973 | Landherr et al. | |
| 4,104,008 | A * | 8/1978 | Hoffmann | F01L 25/063 417/397 |
| 4,381,180 | A | 4/1983 | Sell | |
| 4,680,930 | A | 7/1987 | Dollison | |
| 4,800,797 | A * | 1/1989 | Comarmond | B25D 9/145 91/307 |

FOREIGN PATENT DOCUMENTS

| | | |
|---|---|---|
| DE | 10032024 A1 | 1/2002 |
| EP | 0314994 A1 | 5/1989 |
| FR | 1271152 A | 9/1961 |

* cited by examiner

*Primary Examiner* — Abiy Teka
*Assistant Examiner* — Daniel S Collins
(74) *Attorney, Agent, or Firm* — Verrill Dana, LLP; Robert L. Hover

(57) ABSTRACT

The oscillation cylinder arrangement (100) comprises a working cylinder (10A) and a piston with a rod (27A), arranged to move therein, and a control valve structure (20) for the working cylinder (10A). The control valve structure (20) incorporates a main valve (24) for transmitting a pressure medium to a first sub-chamber or a second sub-chamber of the working cylinder (10A) for a linear movement (A, B) of the piston, as well as impulse valves (22, 23), and lever arms (25, 26) for controlling them, in order to set the operational state of the main valve (24). Control members (27B) fixed to the piston rod (27A) moving in the working cylinder (10A), the control members (27B) being arranged to contact the lever arms (25, 26) of the impulse valves in order to define the extreme positions of the movement of the piston rod (27A).

6 Claims, 4 Drawing Sheets

OSCILLATION CYLINDER ARRANGEMENT

CROSS-REFERENCE TO RELATED APPLICATIONS

The present application is a United States National Stage of International Application No. PCT/FI2018/050768, filed Oct. 19, 2018, which claims priority to Finnish Patent Application No. 20175931, filed on Oct. 20, 2017, the entire contents of both applications are incorporated in the present application by reference.

The invention relates to a control arrangement for an oscillation cylinder. The oscillator cylinder arrangement comprises a working cylinder, a main valve of the working cylinder to lead compressed air into different parts of the working cylinder, and impulse valves to control a change in the direction of movement, caused by the working cylinder, in an actuator controlled by the oscillation cylinder. The impulse valves are controlled by control means fixed to a piston rod moving in the working cylinder, to a portion thereof located outside the cylinder. It is possible to fix several control means in different positions on the piston rod. Due to the movement of the piston, the control means hit impulse valve lever arms according to the invention, defining the extreme positions of the directions of movement of the piston.

PRIOR ART

In the industry, oscillation cylinders are used for creating a repetitive, most often reciprocal, actuator movement in a process apparatus. An oscillation cylinder has a reciprocating piston and a piston rod connected thereto and extending to two opposite sides of the oscillation cylinder. In the first end of the piston rod, an actuator to be driven by the oscillation cylinder is provided. The second end of the piston rod is provided with at least one control member, such as a control disc, which, as it hits the impulse valves relating to the control of the oscillation cylinder, causes a change in the direction of movement of the piston rod. The positions of the control discs on the piston rod are adjustable in order to allow the operation of the process apparatus to be changed if needed. In a known solution, the impulse valves are provided between the adjustable control discs, resulting in that the piston rod, also in case of a short travel length, must move quite far away from the rear end of the oscillation cylinder. Therefore, the control discs must be installed, on the piston rod, considerably more spaced apart from each other than required by the set oscillation cylinder stroke length necessary for the actuator.

Figure 1:
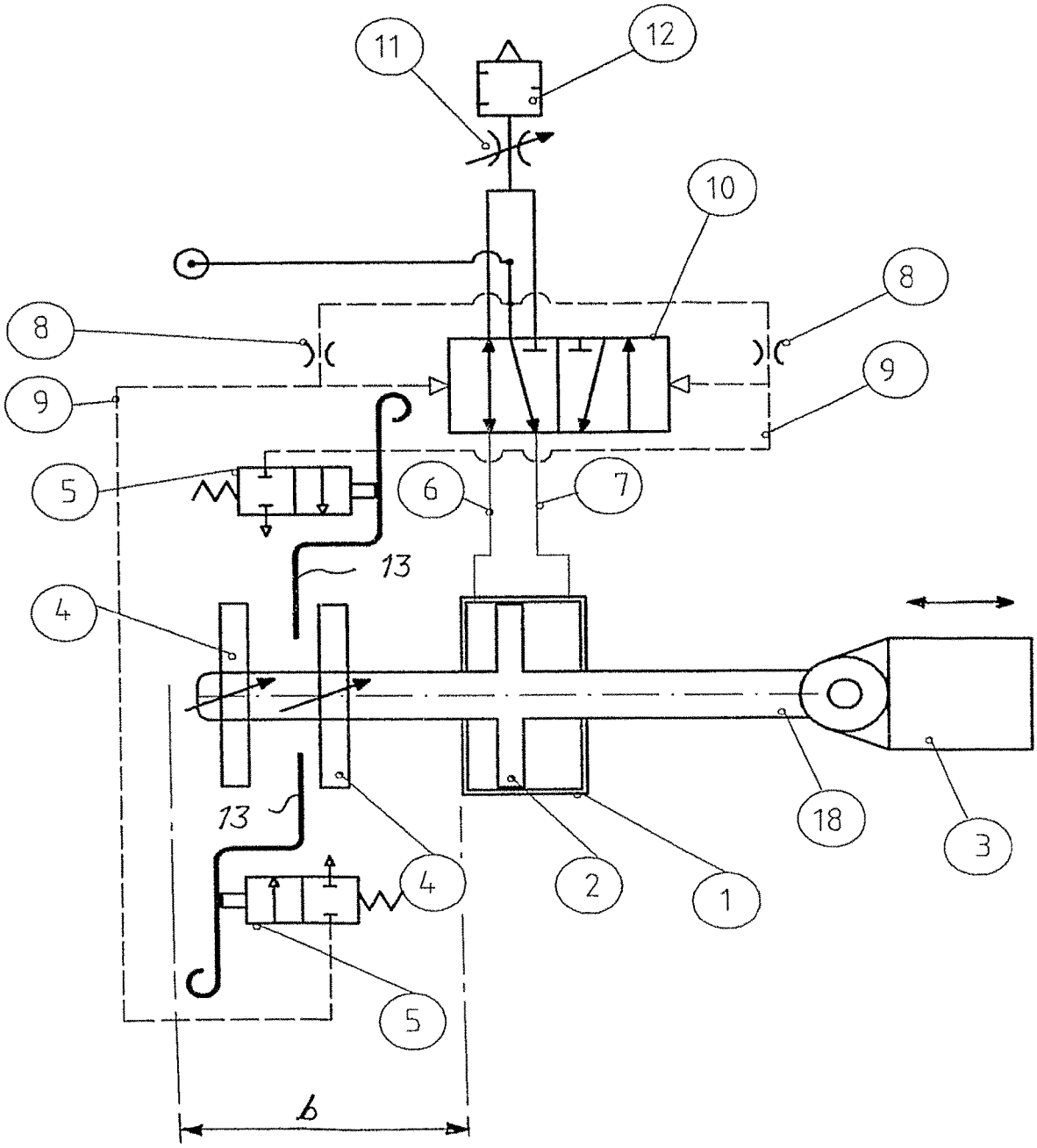
Fig. 1 Prior art

In the arrangement shown in FIG. 1 of WO 2006/056642, the impulse valves are provided in a gap between the adjustable stop discs, intended for controlling the impulse valves, as described above. This arrangement is space-consuming and results in a long mechanical oscillation cylinder structure.

WO 2006/056642 also describes a second type of oscillation cylinder and presents how a valve, intended for controlling it, and impulse valves, related to defining the state thereof, are placed.

Figure 2:
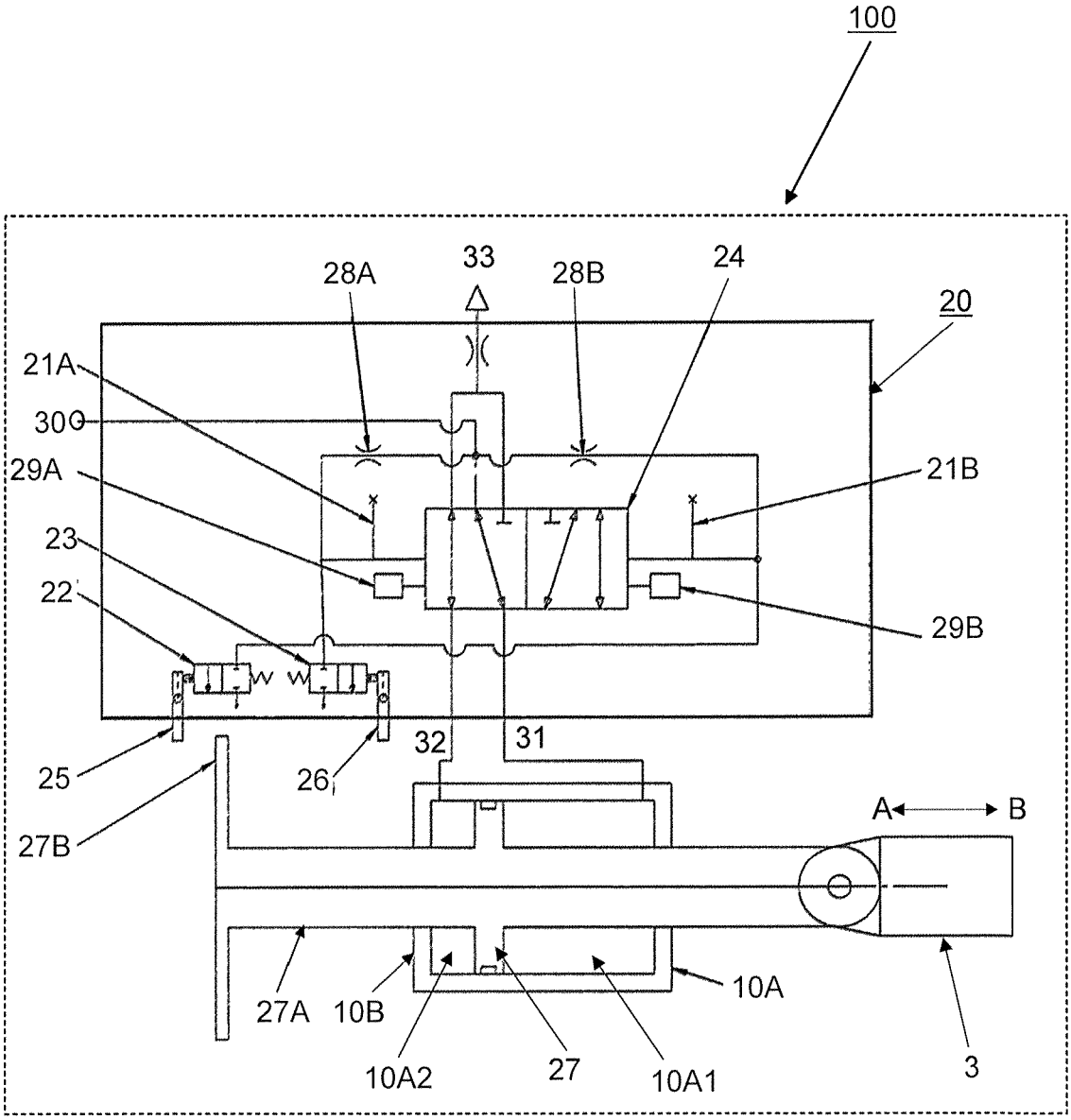

FIG. 1 is a view of the second type of oscillation cylinder shown in FIG. 2 of WO 2006/056642, whose total length has been shortened by controlling the impulse valves 5 by means of appropriate lever arrangements 13 contacting the control discs 4 installed on the piston rod 18. In this solution, the impulse valves are moved away from between the movable control discs 4, to the outside of them.

In FIG. 2 of WO 2006/056642, the control discs 4 are still on the piston rod but they can be quite close to each other. However, neither of the impulse valves 5 used is situated between the control discs 4. The separate movable control arms 13 transmit the movement of the control discs 4 to the impulse valves 5. A pivot-enabling fixing member fixes the control arms 13 to the oscillation cylinder's 1 body. As either of the described control discs 4 hits one of the control arms 13, the impulse valve 5, the opening of which is controlled by this control arm 13, is opened. Now, the direction of movement of the piston rod 18 changes. Later, as the second control disc 4 fixed to the piston rod hits the second control arm 13, the second impulse valve is opened. Now, the piston rod, controlled by the impulse valve, changes its direction of movement again. This results in a reciprocal movement of the piston of the working cylinder, which, in turn, results in a movement of the actual actuator which also can be a linear reciprocating movement.

In the oscillation cylinder according to FIG. 2 of WO 2006/056642, the control discs 4 can be notably closer to each other than in the oscillation cylinder solution according to FIG. 1 of the same patent specification. This allows the necessary outer dimension of the oscillation cylinder to be reduced in the direction of movement of the piston rod.

In the structure according to FIG. 2 of WO 2006/056642, the impulse valves 5 are placed, on two sides of the piston rod 18 of the cylinder, inside an end cover 15 serving as a shield of a change valve 10. In this impulse valve arrangement, the cover portion 15 is wide and also high in the direction of the piston rod, allowing the impulse valves, and the controllers thereof, to be shielded by the cover portion. The cover portion 15 must also allow the piston 18 to move to its extreme position in the rear end of the oscillation cylinder where the impulse valves 5 are located. Therefore, the cover portion 15 must also be designed to have a sufficient height to allow for the movement of the piston rod 18. This cover portion 15 requires parts that are complicated to machine, and, consequently, has high manufacturing costs.

Thus, there exists a need for an oscillation cylinder arrangement comprising both impulse valves, a control valve body and a piston with a rod, having as small structural dimensions as possible in the movement of direction of the piston of the oscillation cylinder, as well as low manufacturing costs and high operational reliability.

Objective of the Invention

The invention aims at providing a novel oscillation cylinder arrangement, allowing to notably diminish the drawbacks and defects associated with prior art oscillation cylinder arrangements.

The objectives of the invention are achieved by means of an oscillation cylinder arrangement with an oscillation cylinder structure comprising a main valve and impulse valves integrated into the same body.

An advantage of the invention is that it allows the outer dimension of the oscillation cylinder to be reduced, in comparison to the known solutions, in the direction of the piston rod.

Another advantage of the invention is that the control valve structure is narrower in a direction transverse to the piston rod, with the impulse valves already being provided in the body of the main valve and, therefore, allowing the covers of the main valve to be made thin.

Another advantage of the invention is that all the flow channels of the control valve structure are provided in the same body, allowing for a smaller number of seals and joints.

BRIEF DESCRIPTION OF THE INVENTION

The oscillation cylinder arrangement according to the invention, comprising a working cylinder, with control members fixed to its movable piston rod, and a control valve structure for the working cylinder, comprising, in turn, a main valve to transmit a pressure medium to a first sub-chamber of the working cylinder, or to a second sub-chamber thereof, for a linear movement of the piston rod in the working chamber, as well as impulse valves, and lever arms for controlling them, in order to set the operational state of the main valve, is characterized in that the operational state of the impulse valves is arranged to be set by the lever arms projecting from the body part of the main valve and controlling the impulse valves, and in that the lever arms are adapted to contact the control members in the extreme positions of the piston rod's movement.

The dependent claims disclose preferred embodiments of the invention.

The basic idea of the invention is as follows: the oscillation cylinder arrangement according to the invention comprises a prior-art working cylinder and a control valve structure attached to the second end of the working cylinder. The control valve structure, in turn, comprises a main valve of the oscillation cylinder, provided with a pressure medium, preferably compressed air. The operational state of the main valve determines to which sub-chamber of the working cylinder, the first sub-chamber or the second sub-chamber, the pressure medium is supplied for a linear movement of the piston rod moving in the working cylinder. The same control valve structure also incorporates impulse valves for controlling the direction of movement of the spindle of the main valve. Preferably, the control of the operational state of the impulse valves utilizes one or more lever arms, projecting from one side of the main valve's body, with a capability of inclining in the direction of movement of the piston, and arranged to be hit by at least one, preferably disc-shaped, control member provided on the piston rod of the working cylinder, as the piston rod reaches either of its extreme positions. The control member hitting the lever arm causes the lever arm to pivot, this pivot movement being arranged to open the impulse valve. The opening of the impulse valve, in turn, changes the pressure medium flow from the main valve to the sub-chamber of the working cylinder in which the pressure rise forces the movement of direction of the piston rod to take a 180-degree change.

MORE DETAILED DESCRIPTION OF THE EXAMPLES OF THE INVENTION

Figure 3:
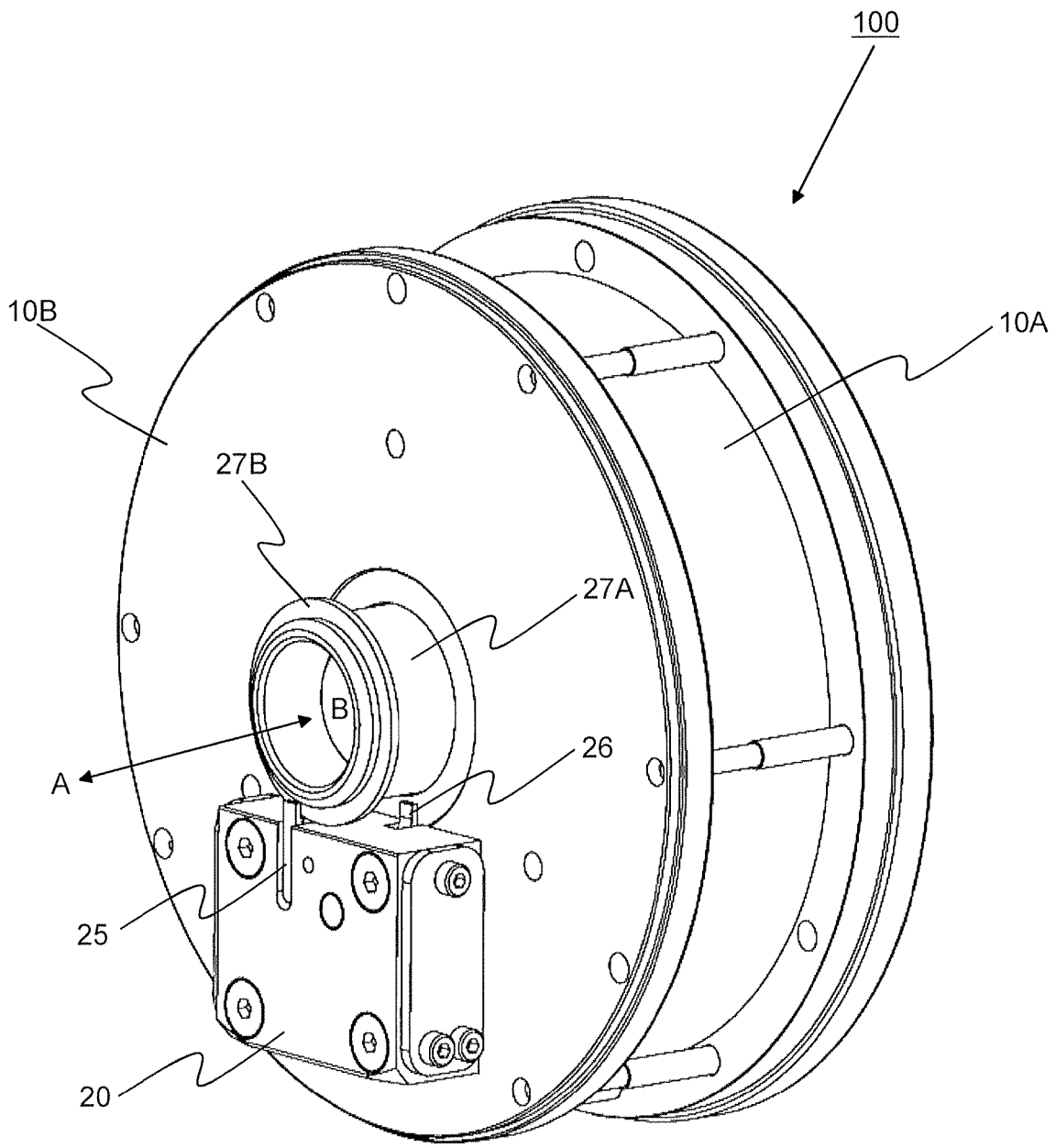

In the following, the invention will be described in detail. The description refers to the accompanying schematic drawing wherein FIG. 1 is an exemplary view of a prior-art operational scheme of an oscillation cylinder arrangement, FIG. 2 is an exemplary view of an operational scheme of an oscillation cylinder arrangement according to the invention, FIG. 3 is perspective view of way of connecting a control valve structure of the oscillation cylinder according to the invention to second end of the oscillation cylinder, and FIGS. 4A-4D show four preferred embodiments of a main valve according to the invention.

The embodiments included in the following description are only exemplary, allowing a person skilled in the art to implement the basic idea of the invention in a way differing from the description. Although several places of the description may refer to a specific embodiment or specific embodiments, this does not mean that the reference only is limited to this single embodiment described, or that the disclosed feature only is applicable to this single embodiment described. Combinations of any individual features of two or more embodiments are feasible for creating new embodiments of the invention.

FIG. 1, showing a prior-art operational scheme of an oscillation cylinder solution, has been explained above in the description of the prior art.

FIG. 2 is an exemplary view of an operational scheme of an oscillation cylinder arrangement 100 according to the invention.

The oscillation cylinder arrangement 100 controls the movement of an actuator 3 present in an industrial process. This movement can be, for example, a reciprocal, linear movement of the actuator 3, indicated, in FIG. 2, by an arrow with a head at each end and having extreme positions denoted by letters A and B.

The linear movement is generated by a piston 27 arranged to move back and forth in a working cylinder 10A and connected to a piston rod 27A. In the working cylinder 10A, the direction of the piston's 27 movement, which is either direction A or direction B, is determined by which of the sub-chambers 10A1 or 10A2 of the working cylinder 10A, formed on different sides of the piston 27 and varying in volume, has a higher pressure. A pressure medium flows into the first sub-chamber 10A1 and the second sub-chamber 10A2 through lines 31 and 32, respectively. Preferably, the pressure medium used is compressed air, supplied or discharged, through the lines 31, 32, from a main valve 24 controlling the operation of the working cylinder 10A. The compressed air, which enters from a compressed air grid, is supplied to the main valve 24 from a compressed air inlet 30 of a control valve structure 20.

The main valve 24 controls the flow of the compressed air in the lines 31 and 32. Preferably, a spindle arranged to move from one extreme position to another is provided inside the main valve 24. In the first extreme position of the spindle, the main valve 24 supplies, through the line 31, compressed air into the first sub-chamber 10A1 of the working cylinder 10A, and, at the same, opens up a discharge channel 33 for the air to be discharged from the second sub-chamber 10A2. In the second extreme position of the spindle, the main valve 24 supplies, through the line 32, compressed air into the second sub-chamber 10A2 of the working cylinder 10A, and, at the same, opens up the discharge channel 33 for the air to be discharged from the first sub-chamber 10A1.

The control of the spindle of the main valve 24 is implemented in such a way that impulse valves 22 and 23 operate as pressure discharge valves, alternately discharging pressure from the main valve 24 in order to control the movement of the spindle. However, a small amount of compressed air is continuously flowing from choke nozzles 28A, 28B into that section of the channel system which extends to the impulse valves 22, 23. The choke nozzles refer to a suitable dimension of a point of the channel system. It is essential where this choking portion or point is in the channel system. The nozzles can be either separate from or form part of the channel system. However, because the flow orifice of the impulse valves 22 and 23 is larger than the flow orifices of the choke nozzles 28A and 28B, said impulse valves 22, 23 are, under control, capable of generating a sufficiently quick pressure reduction in order to change the operational state of the main valve 24. The impulse valves 22 and 23 operate, under the control of the lever arms 25 and 26, by means of one or more control members 27B fixed to the piston rod 27A moving in the working cylinder 10A.

For a simpler oscillation cylinder structure, the impulse valves 22 and 23 are provided in the body of the main valve 24. In the preferred embodiment shown in FIG. 2, the lever arms 25 and 26 controlling the impulse valves 22 and 23 are installed in the body of the main valve 24, on two opposite sides of one face thereof, suitably extending to contact the one or more control members 27B fixed to the piston rod 27A moving in the working cylinder 10A. Preferably, the covers of the main valve 24 are simple, plate-like parts. Because, in the control valve structure 20 according to the invention, all the channels required for the control of the valves are incorporated in the body of the main valve 25, the oscillation cylinder arrangement 100 according to the invention has low costs and high operational reliability.

If the spindle of the main valve 24 is provided with seals, there is always some friction there. If the pressure of the compressed air entering the oscillation cylinder arrangement 100 becomes too low, there is a danger of the pressure, generating the movement of the control spindle of the main valve 24 and present in the volume between the nozzle and the impulse valve, not being sufficient to effectively push the spindle into the second extreme position. Consequently, the direction of movement of the working cylinder cannot be changed.

Figure 4A:
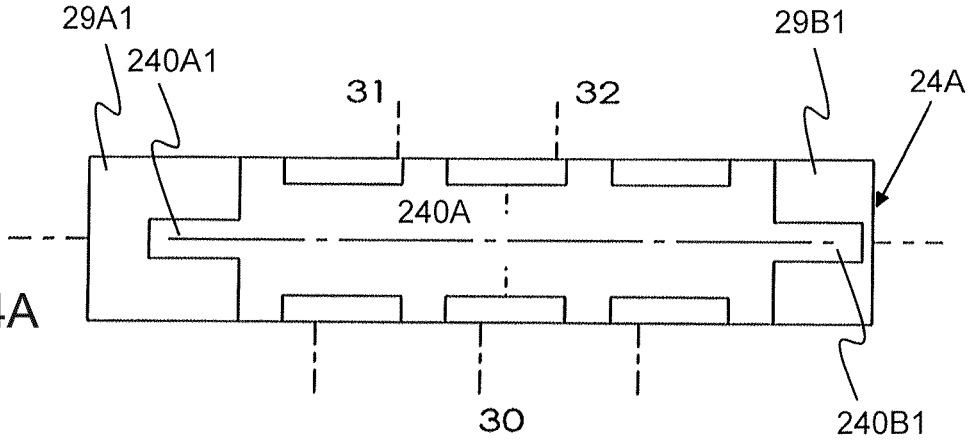
Figure 4B:
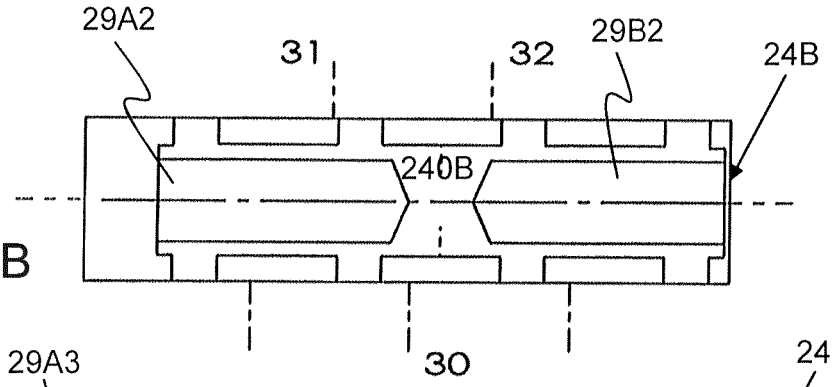
Figure 4C:
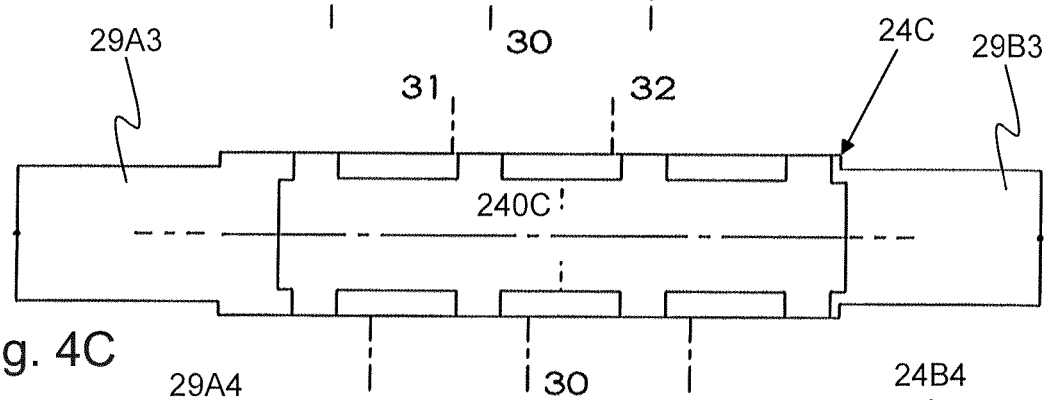
Figure 4D:
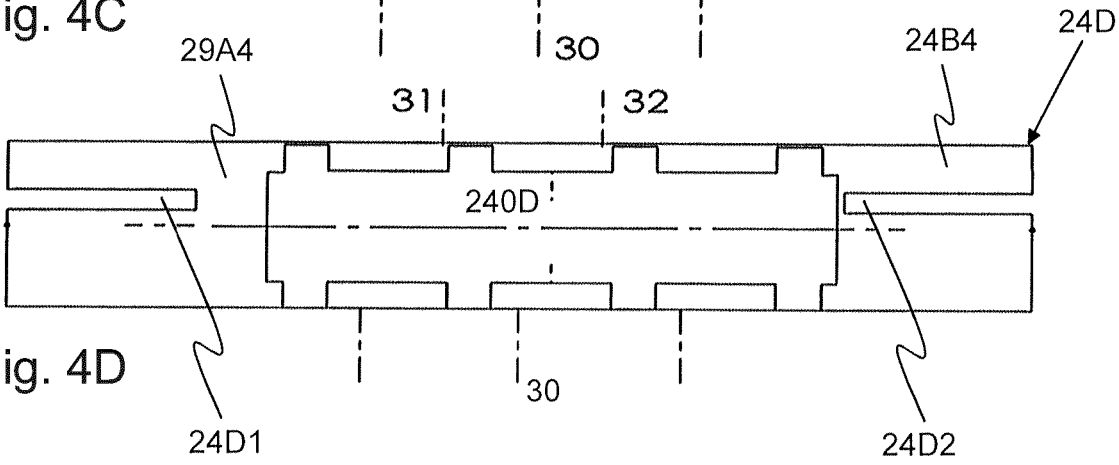

To avoid this fault situation in the oscillation cylinder arrangement 100 according to the invention, an additional volume is provided in the compressed-air filled section of the channel system extending from the nozzles 28A, 28B to the impulse valves 22, 23. Preferably, additional volumes can be created by enlarging the diameter of the channel system, or, by providing extra boreholes, referred to by 21A and 21B, or chambers 29A, 29B as additional compressed-air reservoirs, in the channel system. In a preferred embodiment of the invention, an extra volume can be machined in each end of the spindle of the main valve 24, for example by providing them with boreholes, as shown in FIG. 4B, or by adding stroke-length limiting projections, as shown in FIG. 4A, or, by limiting the movement of the spindle in some other way, as shown in FIGS. 4C and 4D. Preferably, the volume of the resulting air reservoirs is more than 2 times the volume displaced by the spindle of the main valve (24) during its movement from one extreme position to the other.

FIG. 3 is perspective view of the oscillation cylinder system 100 according to the invention. The piston 27 provided in the working cylinder 10A moves reciprocally in direction A↔B. A preferably annular control member 27B is provided in the end of the piston rod 27A shown in FIG. 3. The control valve structure 20 is attached to the second end 10B of the working cylinder, being situated, in the example shown in FIG. 3, below the piston rod 27A. As the piston rod 27A travels far enough in direction A, the control member 27B provided on the piston rod 27A eventually hits the lever arm 25 of the impulse valve 22. As the tip of the lever arm 25 moves in direction A, the discharge valve of the impulse valve 22 is opened. The impulse valve 22 generates a pressure reduction which guides the spindle of the main valve 24 to a position that causes the compressed air in the first sub-chamber 10A1 of the working cylinder 10A to lead its way out of there. Now, the higher pressure of the compressed air led into the second sub-chamber 10A2 of the working cylinder 10A turns the movement of the piston rod 27A in direction B. As the control member 27B provided on the piston rod 27D reaches, after a while, the lever arm 26 of the second impulse valve 23, the movement of the piston rod 27A, as described above, turns in direction A again.

FIGS. 4A, 4B, 4C and 4D show alternative embodiments of the invention for providing an additional volume in the control channel systems.

FIG. 4A shows a preferred embodiment of a spindle 240A of a first main valve 24A according to the invention. Pin projections are provided in both ends of the spindle 240A. The pin projection 240A1 creates an additional volume 29A1 in the first end of the main valve 24A. The pin projection 240B1 creates an additional volume 29B1 in the first end of the main valve 24A.

FIG. 4B shows a preferred embodiment of a spindle 240B of a second main valve 24B according to the invention. Cavities are drilled in both ends of the spindle 240B. The drilled cavity 29A2 creates an additional volume in the first end of the spindle 240B the main valve 24B. The drilled cavity 29B2 creates an additional volume in the second end of the spindle 240B of the main valve 24B.

FIG. 4C shows a preferred embodiment of a spindle 240C of a third main valve 24C according to the invention. Cavities having a smaller diameter than the diameter of the spindle 240C of the main valve 24C are provided in both ends of the main valve 24C. Hence, both ends of the main valve have shoulders defining the extreme positions of the spindle 240C. A cavity 29A3 unreachable by the spindle 240C is provided in the first end of the main valve 24C. Correspondingly, a cavity 29B3 unreachable by the spindle 240C is provided in the second end of the main valve 24C.

FIG. 4D shows a preferred embodiment of a fourth main valve 24D and a spindle 240D according to the invention. In this embodiment, pin projections directed towards the spindle 240D are provided in both ends of the body part of the main valve 24D. The pin projection 240D1 creates an additional volume 29A4 in the first end of the main valve 24D. The pin projection 240D2 creates an additional volume 29B4 in the first end of the main valve 24D.

The outer dimensions of the control valve structure 20 utilized in the oscillation cylinder arrangement 100 are so small that it fits into a circular sector smaller than ⅓ of the area of the circular rear end 10B of the working cylinder 10A.

The above describes preferred embodiments of the oscillation cylinder solution according to the invention. The invention is not restricted to these embodiments but the inventive idea has numerous applications within the scope defined by the claims.

The invention claimed is:

1. An oscillation cylinder arrangement comprising:

a working cylinder and a piston with a rod, arranged to move therein, a control valve structure for the working cylinder, comprising a main valve provided with a channel system for transmitting a pressure medium to a first sub-chamber or a second sub-chamber of the working cylinder for achieving a linear movement of the piston, impulse valves and lever arms for controlling said impulse valves in order to set an operational state of the main valve, and control members fixed to the piston rod, which moves in the working cylinder, and arranged to contact the lever arms of the impulse valves in order to define first and second extreme positions of a movement of the piston rod, wherein an extra volume is provided in the channel system of the main valve in order to keep a control pressure rate at operating level, and wherein the extra volume is provided in the channel system of the control valve structure, in a channel between nozzles and discharge openings of the impulse valves, by enlarging the channel system, and in that each of these sections of the channel system separately have a volume more than 2 times the volume displaced by the spindle of the main valve while moving from the first extreme position to the second extreme position.

2. The oscillation cylinder arrangement of claim 1, wherein the extra volume is provided in the channel system of the main valve by means of additional chambers, boreholes, or projections on the spindle, or boreholes in the spindle, in order to keep the control pressure rate at operating level.

3. The oscillation cylinder arrangement of claim 1, wherein the main valve and the impulse valves are provided in the same control valve structure body in the direction of movement of the working cylinder.

4. The oscillation cylinder arrangement of claim 1, wherein the lever arms used for controlling the impulse valves are arranged to project from the same outer face of the main valve.

5. The oscillation cylinder arrangement of claim 1, wherein the lever arms are arranged to contact the same sector of the control members which is smaller than ⅓ of the area of discharge openings of the impulse valves surrounding the central axis of the oscillation cylinder.

6. The oscillation cylinder arrangement of claim 1, wherein the impulse valves are provided, together with the main valve in the body of the control valve structure, the control valve structure being fittable into a circular sector smaller than ⅓ of the total area of discharge openings of the impulse valves of the oscillation cylinder.

* * * * *